US008976933B2

(12) United States Patent
Lopez et al.

(10) Patent No.: US 8,976,933 B2
(45) Date of Patent: Mar. 10, 2015

(54) METHOD FOR SPATIALLY MODULATING X-RAY PULSES USING MEMS-BASED X-RAY OPTICS

(75) Inventors: Daniel Lopez, Chicago, IL (US); Gopal Shenoy, Naperville, IL (US); Jin Wang, Burr Ridge, IL (US); Donald A. Walko, Woodridge, IL (US); Il-Woong Jung, Woodridge, IL (US); Deepkishore Mukhopadhyay, Chicago, IL (US)

(73) Assignee: UChicago Argonne, LLC, Chicago, IL (US)

( * ) Notice: Subject to any disclaimer, the term of this patent is extended or adjusted under 35 U.S.C. 154(b) by 822 days.

(21) Appl. No.: 13/246,008

(22) Filed: Sep. 27, 2011

(65) Prior Publication Data

US 2013/0077759 A1 Mar. 28, 2013

(51) Int. Cl.
*G21K 1/06* (2006.01)

(52) U.S. Cl.
CPC . *G21K 1/06* (2013.01); *G21K 1/067* (2013.01)
USPC ..... 378/145

(58) Field of Classification Search
CPC ..... G21K 1/06; G21K 1/104; G21K 1/067; G21K 2201/067; A61B 6/0306; A61B 6/06
USPC ..... 378/70, 71, 82, 145
See application file for complete search history.

(56) References Cited

U.S. PATENT DOCUMENTS

| | | | | |
|---|---|---|---|---|
| 7,653,173 | B2 | 1/2010 | Boyden et al. | |
| 8,058,608 | B1 * | 11/2011 | Deason | 250/225 |
| 2009/0068596 | A1 | 3/2009 | Yang et al. | |
| 2010/0265382 | A1 * | 10/2010 | Khalil et al. | 348/335 |
| 2011/0102871 | A1 * | 5/2011 | Godil | 359/200.6 |
| 2011/0192248 | A1 | 8/2011 | Lopez et al. | |

OTHER PUBLICATIONS

"A MEMS-based high frequency x-ray chopper", by A Siria, O. Dhez, W.Schwartz, G. Torricelli, F. Comin and J Chevrier, Nanotechnology 20 (2009) 175501-175504.

"Capacitive MEMS Microphones" by D. López, et al. Bell Labs Technical Journal (2005) 10 (3), 187-198.

"MEMS-Based Channelized Dispersion Compensator With Flat Passbands", by D. Neilson et al., J. Lightwave Technology, (2004) 22, 101.

"A synchronized rotating crystal x-ray beam chopper" by McPherson, A., Lee, W.-K. & Mills, D. M. (2002). Rev. Sci. Instrum. 73, 2852-2855.

"Feasibility study into the use of mechanical choppers to alter the natural time structure of the APS", by Mills, D. M (1989). Rev. Sci. Instrum. 60, 2338-2341.

"Extraction of single bunches of synchrotron radiation from storage rings with an X-ray chopper based on a rotating mirror", by Kosciesza, D. & Bartunik, H. D. (1999). J. Synchrotron Rad. 6, 947-952.

(Continued)

*Primary Examiner* — Irakli Kiknadze

(74) *Attorney, Agent, or Firm* — Joan Pennington

(57) ABSTRACT

A method and apparatus are provided for spatially modulating X-rays or X-ray pulses using microelectromechanical systems (MEMS) based X-ray optics. A torsionally-oscillating MEMS micromirror and a method of leveraging the grazing-angle reflection property are provided to modulate X-ray pulses with a high-degree of controllability.

18 Claims, 16 Drawing Sheets

(56) References Cited

OTHER PUBLICATIONS

"On the design of ultrafast shutter for time-resolved synchrotron experiments" by Milan Gembicky and Philip Coppens, J. Synchrotron Rad. (2007). 14, 133-137.

"An Ultrafast Mechanical Shutter of X-Rays" by LeGrand, A. D., Schildkamp, W. & Blank, B. (1989). Nucl. Instrum. Methods Phys. Res. A, 275, 442-446.

U.S. Appl. No. 13/022,353, filed Feb. 7, 2011 by Daniel A. Lopez et al., entitled "Microelectomechanical (MEMS) Manipulators for Control of Nanoparticle Coupling Interactions".

* cited by examiner

DERIVATIVE OF MEASURED REFLECTIVITY CURVE SHOWS MIRROR CURVATURE LESS THAN 0.02°

METHOD FOR SPATIALLY MODULATING X-RAY PULSES USING MEMS-BASED X-RAY OPTICS

The United States Government has rights in this invention pursuant to Contract No. DE-AC02-06CH11357 between the United States Government and UChicago Argonne, LLC representing Argonne National Laboratory.

FIELD OF THE INVENTION

The present invention relates generally to the temporal modulation of X-rays, and more particularly, relates to a method and apparatus for spatially modulating X-rays or X-ray pulses using MicroElectroMechanical or microelectromechanical systems (MEMS) based X-ray optics including oscillating MEMS micromirrors.

DESCRIPTION OF THE RELATED ART

MEMS refer to very small mechanical devices driven by electricity. For example, MEMS are made up of components between 1 and 100 micrometers in size or between 0.001 mm and 0.1 mm, and MEMS devices typically range in size from 20 micrometers to a millimeter.

A need exists for an X-ray modulating optics mechanism for spatially modulating X-rays pulses, for example with X-ray pulses of microsecond (μs) to picosecond (ps) duration. It is desirable to provide such an X-ray modulating optics mechanism that enables modulation of X-ray pulses with a high-degree of controllability.

SUMMARY OF THE INVENTION

Principal aspects of the present invention are to provide a method and apparatus for spatially modulating X-rays or X-ray pulses using MEMS based X-ray optics. Other important aspects of the present invention are to provide such method and apparatus substantially without negative effect and that overcome some of the disadvantages of prior art arrangements.

In brief, a method and apparatus are provided for spatially modulating X-rays or X-ray pulses using microelectromechanical systems (MEMS) based X-ray optics. A micromirror including a torsionally-oscillating MEMS micromirror and a method of leveraging the grazing angle and reflection property of the MEMS micromirror are provided to modulate X-ray pulses with a high-degree of controllability.

In accordance with features of the invention, a combination of grazing angle reflection and controllable mirror-oscillation provides a method for modulating the incident X-ray beam. This modulation includes, for example, isolating a particular pulse, spatially separating individual pulses, and spreading a single pulse from an X-ray pulse-train.

In accordance with features of the invention, an incident X-ray beam is provided on the MEMS micromirror surface at a set angle of incidence or grazing angle, θ. The set grazing angle, θ of the incident X-ray beam is provided at a selected angle less than a critical angle, $\theta_c$, for a given X-ray wavelength and MEMS micromirror material, the incident X-ray beam is reflected off the micromirror surface with close to 100% optical efficiency.

In accordance with features of the invention, a MEMS micromirror includes a torsional minor. The MEMS micromirror is fabricated on a single-crystal-silicon (SCS) device layer of a Silicon-On-Insulator (SOI) wafer, using conventional semiconductor fabrication technique.

In accordance with features of the invention, a MEMS micromirror includes a set mirror frequency or minor oscillation frequency.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1A:
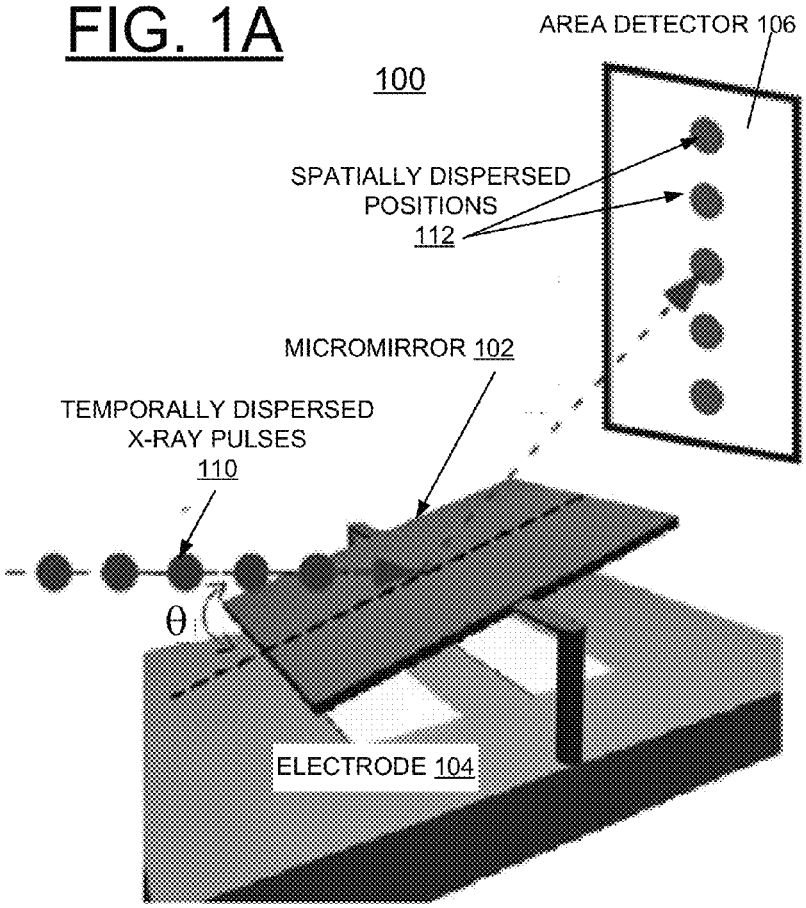
FIGS. 1A and 1B schematically illustrate example MEMS X-ray optics apparatus for implementing spatially modulating X-rays or X-ray pulses respectively with example temporally dispersed X-ray pulses and with short pulse dispersion in accordance with preferred embodiments.

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a method and apparatus are provided for implementing spatially modulating X-rays. MEMS X-ray optics apparatus module X-rays by deflecting or dispersing incident X-ray beams using oscillating MEMS micromirrors. The novel MEMS X-ray optics apparatus of the invention delivers X-ray pulses with a picosecond (ps) temporal resolution with broad energy tunability, and a high pulse repetition-rate with high flux per pulse.

Having reference now to the drawings, in FIGS. 1A-1D, there is shown an example MEMS X-ray optics apparatus for implementing spatially modulating X-rays or X-ray pulse generally designated by the reference character 100 in accordance with the preferred embodiment.

MEMS X-ray optics apparatus 100 includes a MEMS micromirror generally designated by the reference character 102 shown supported by an electrode 104 and an area detector 106. X-rays reflect off micromirror 102 at incidence angles, $\theta<\theta c$, critical angle as shown in FIGS. 1A-1D. MEMS X-ray optics apparatus module X-rays by deflecting or dispersing incident X-ray beams using oscillating MEMS micromirrors.

Figure 1B:
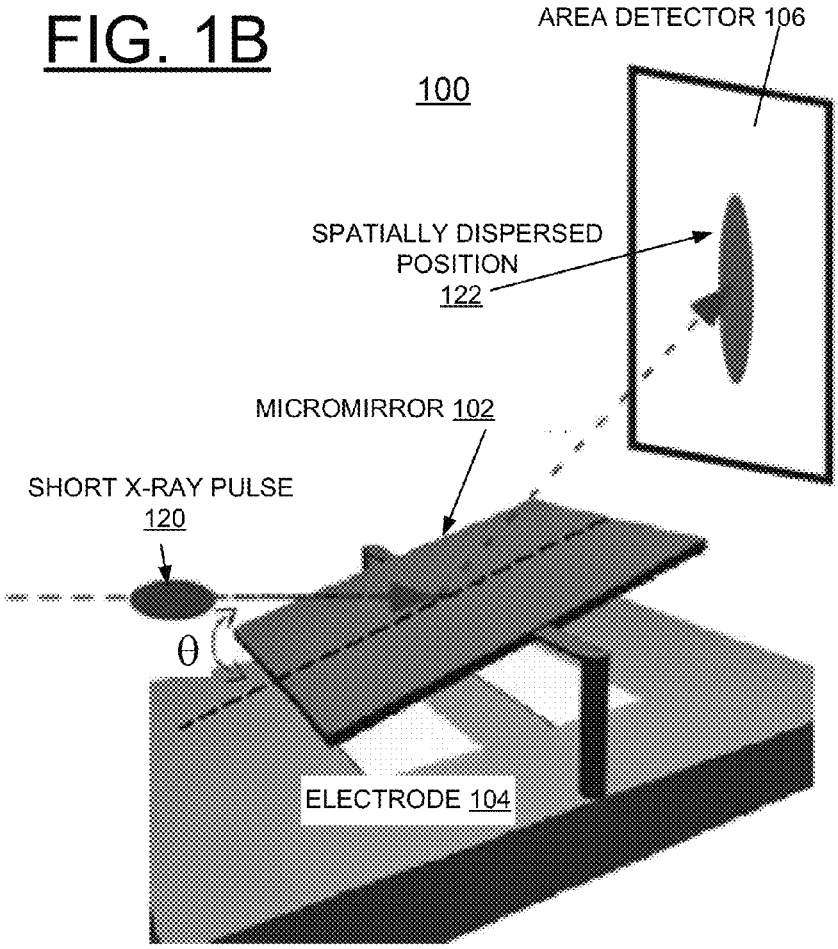

In accordance with features of the invention, as shown in FIGS. 1A-1B, an incident X-ray beam of an incident X-ray beam from a synchrotron source, such as the Advanced Photon Source (APS) at Argonne National Laboratory, is placed on the MEMS micromirror 102 at a very low, grazing angle, $\theta$. When the grazing angle, $\theta$ is less than the critical angle, $\theta_c$, for a given X-ray wavelength and MEMS-mirror-material, the incident X-ray beam is reflected off the micromirror surface with close to 100% optical efficiency. However, at angles greater than the critical angle the optical efficiency drops sharply.

Figure 1C:
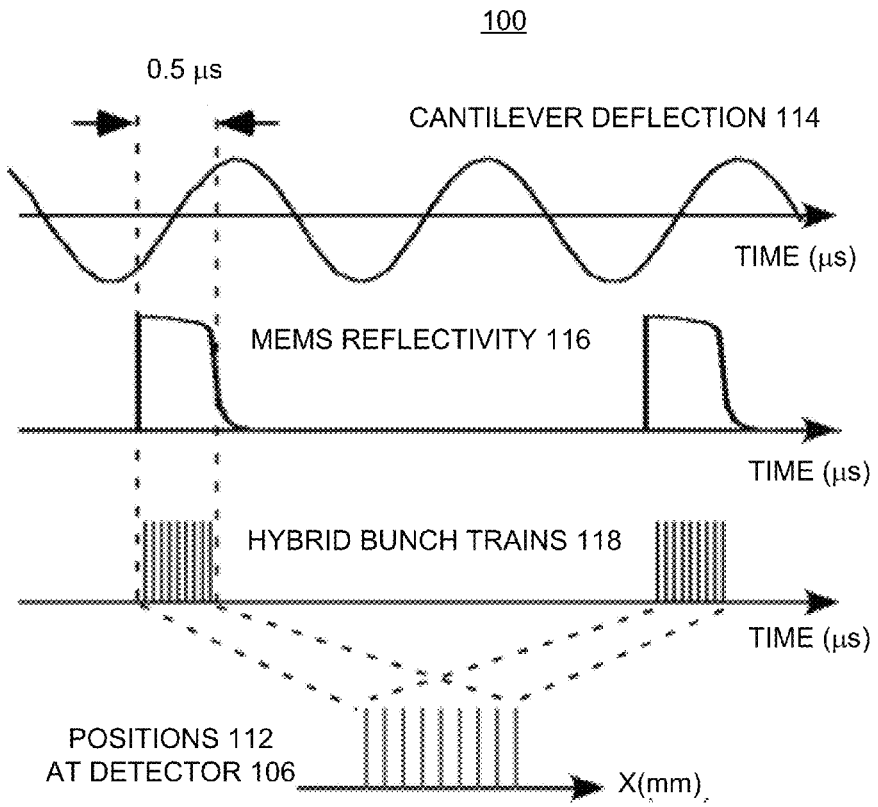
FIGS. 1C and 1D are respective example timing sequences or waveforms illustrating the pulse train dispersion operation with example temporally dispersed X-ray pulses of the apparatus of FIG. 1A, and short pulse dispersion operation with example temporally dispersed X-ray pulses of the apparatus of FIG. 1B in accordance with preferred embodiments.

In FIG. 1A, temporally dispersed X-ray pulses 110 are placed on surface of the MEMS micromirror 102 at the low grazing angle, $\theta$ are spatially dispersed at positions 112 onto the area detector 106. Referring to FIG. 1C, the temporally dispersed X-ray pulses dispersion is illustrated including respective waveforms labeled CANTILEVER DEFLECTION 114, MEMS REFLECTIVITY 116, HYBRID BUNCH TRAINS 118, and POSITIONS 112 at detector 106.

Figure 1D:
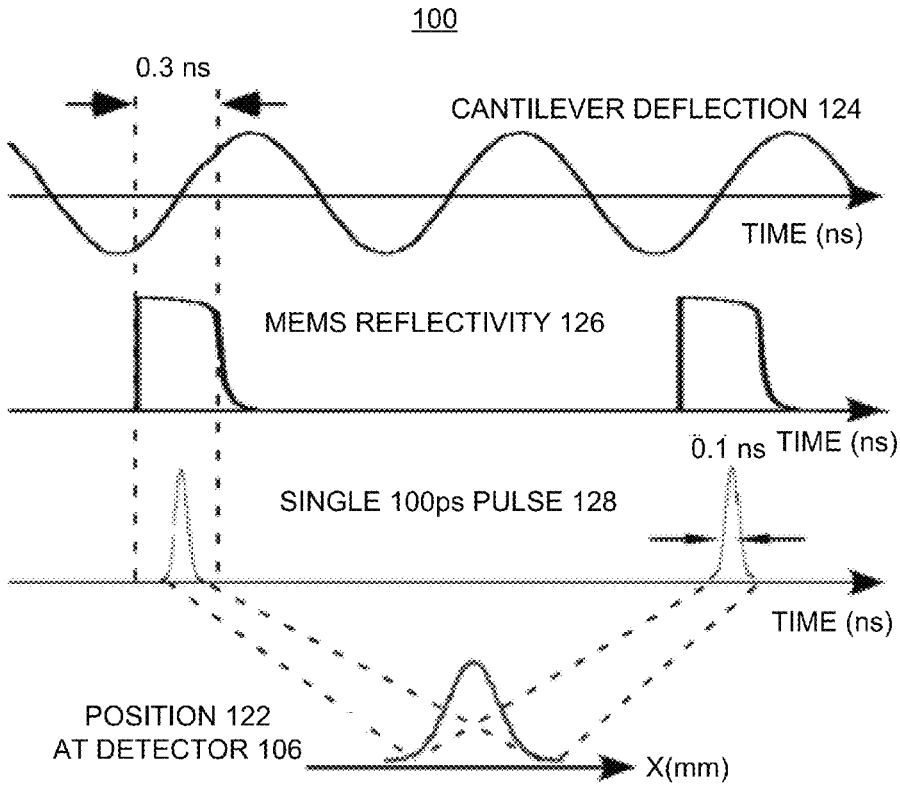

In FIG. 1B, a short X-ray pulse 120, is placed on surface of the MEMS micromirror 102 at the low grazing angle, $\theta$ is spatially dispersed at position 122 onto the area detector 106. Referring to FIG. 1D, the short X-ray pulse dispersion is illustrated including respective waveforms labeled CANTILEVER DEFLECTION 124, MEMS REFLECTIVITY 126, SINGLE 100ps PULSE 128, and position 122 at detector 106.

Figures 2A, 2B:
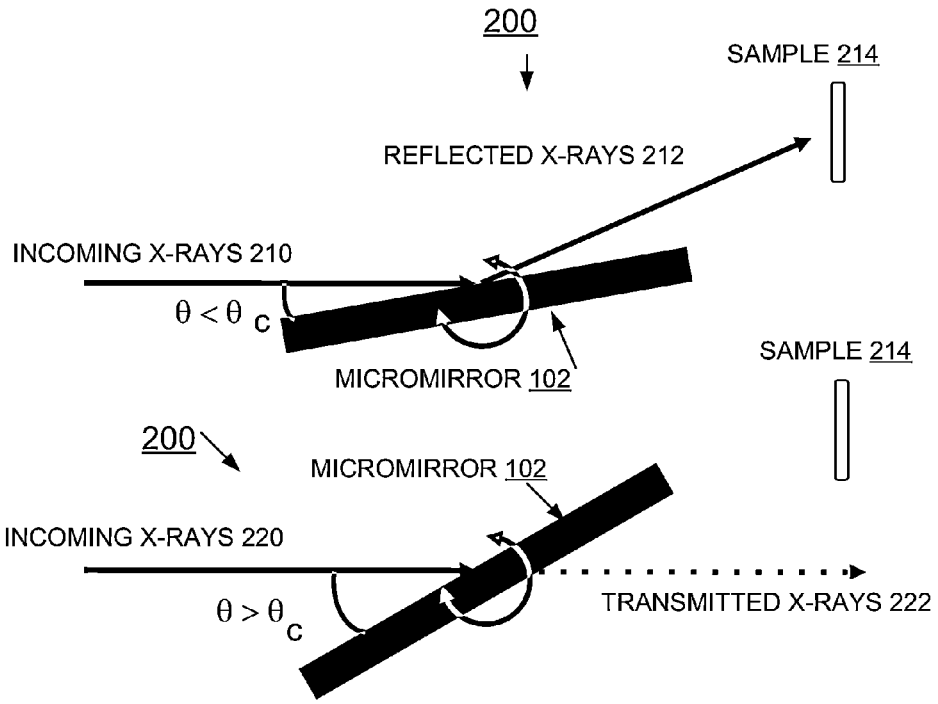
FIGS. 2A and 2B schematically illustrate example MEMS X-ray optics apparatus for implementing spatially modulating X-rays respectively with example incidence angles less than and greater than a critical angle in accordance with a preferred embodiment.

Referring to FIGS. 2A and 2B there is shown an example MEMS X-ray optics apparatus for implementing spatially modulating X-rays designated by the reference character 200 respectively with and greater than the critical angle $\theta>\theta c$ in accordance with the preferred embodiment.

In FIG. 2A, example incoming X-rays 210 with incidence angles less than the critical angle $\theta<\theta c$ are reflected off the micromirror 102 providing reflected X-rays 212 to a sample 214. As illustrated in FIG. 2B, example incoming X-rays 220 are transmitted through the micromirror 102 with incidence angles greater than the critical angle $\theta>\theta c$ providing transmitted X-rays 222 spaced from the sample 214.

In accordance with features of the invention, the micromirror 102 is implemented by a torsionally-oscillating micro-electro-mechanical system (MEMS) micromirror together with a method of leveraging the grazing-angle reflection property, to modulate X-ray pulses with a high-degree of controllability.

Figure 3:
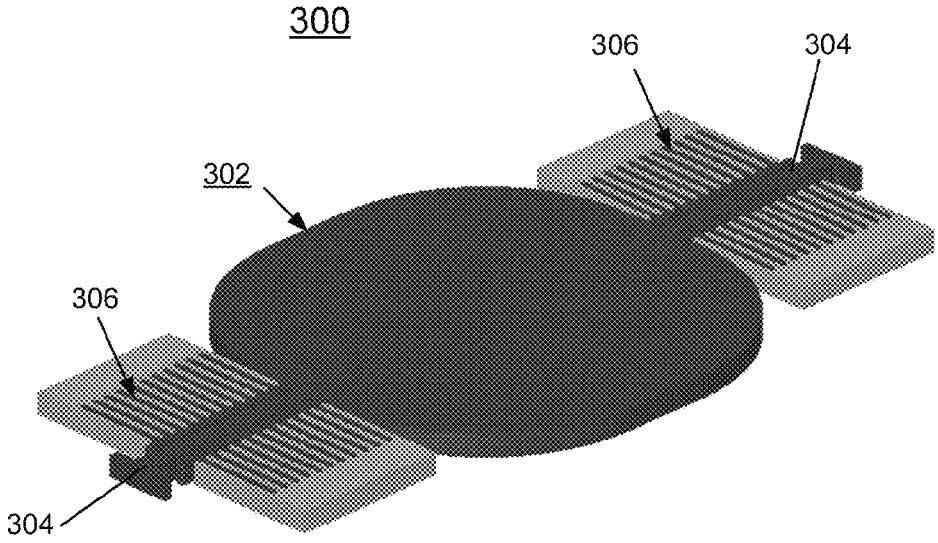
FIGS. 3 and 4 schematically illustrate a respective example MEMS micromirror of the example MEMS X-ray optics apparatus of FIGS. 1A and 1B and FIGS. 2A and 2B in accordance with preferred embodiments.
Figure 4:
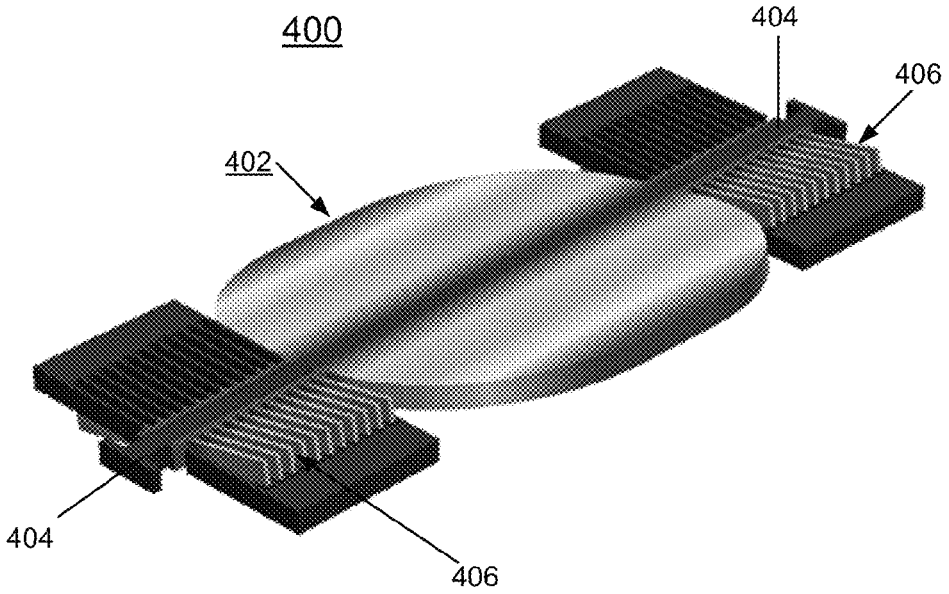

Referring to FIGS. 3 and 4 there are shown a respective example MEMS micromirror generally designated by the respective reference character 300 and reference character 400 in accordance with preferred embodiments. MEMS micromirrors 300 and 400 include a respective micromirror 302, 402 provided together with a respective pair of torsional hinge 304, 404 and a respective pair of comb-drive actuator 306, 406 disposed on opposed sides of the respective micromirror 302, 402. Oscillation of the micromirrors 300 and 400 is provided by the respective in-plane comb-drive actuator 306, 406.

In accordance with features of the invention, the MEMS micromirrors 102, 300 and 400 are fabricated, for example, on the single-crystal-silicon (SCS) device-layer of a Silicon-On-Insulator (SOI) wafer, using standard semiconductor fabrication processes.

Figure 5A:
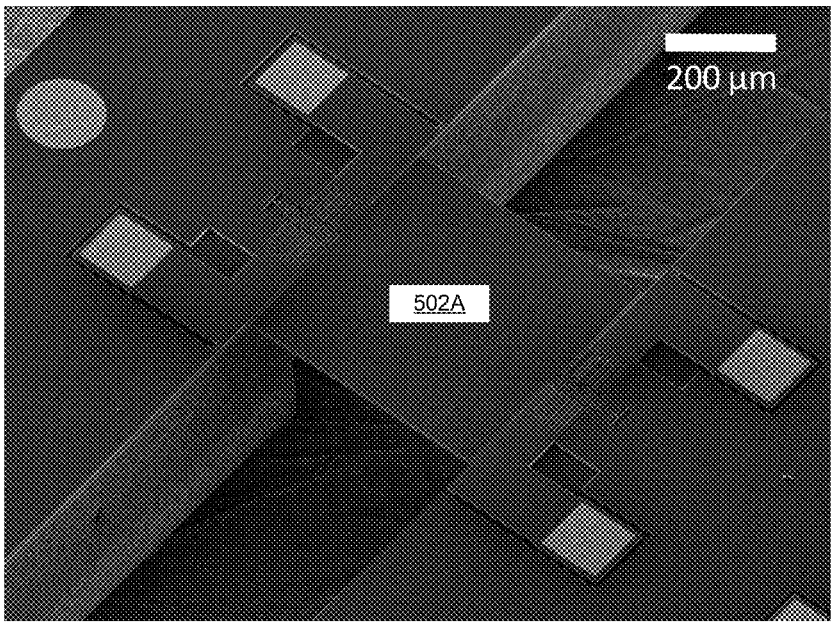
FIGS. 5A, 5B, and 5C illustrate respective SEM micrograph of example MEMS micromirrors.
Figure 5B:
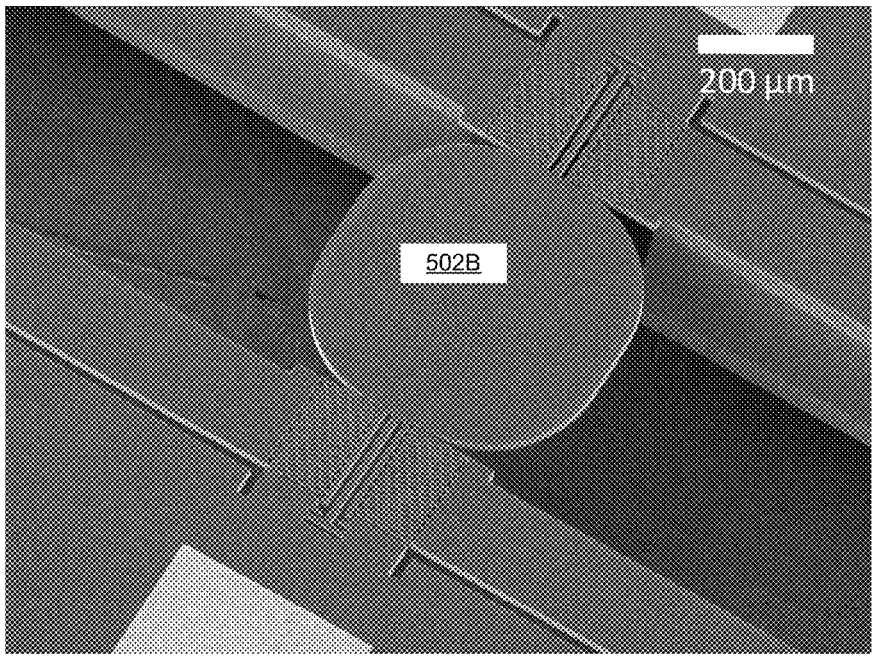
Figure 5C:
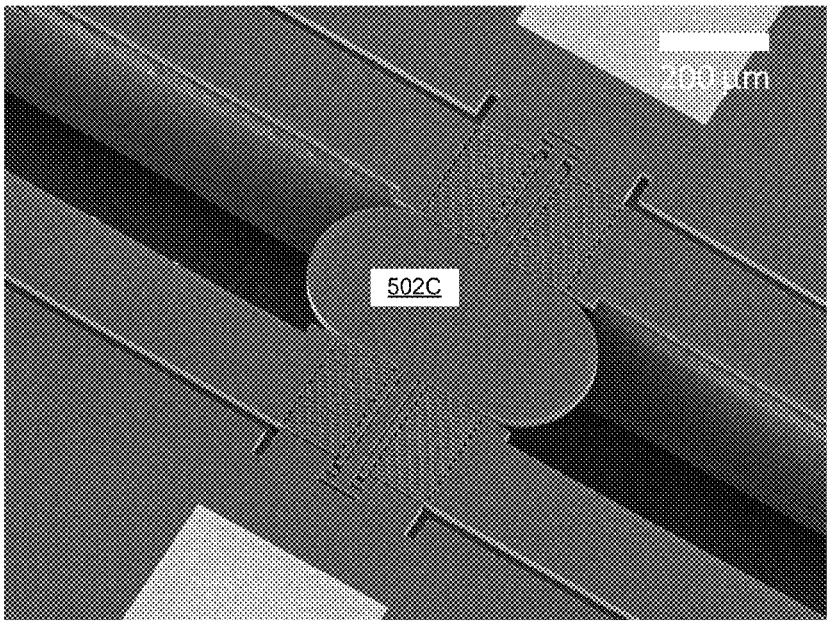
Figure 5D:
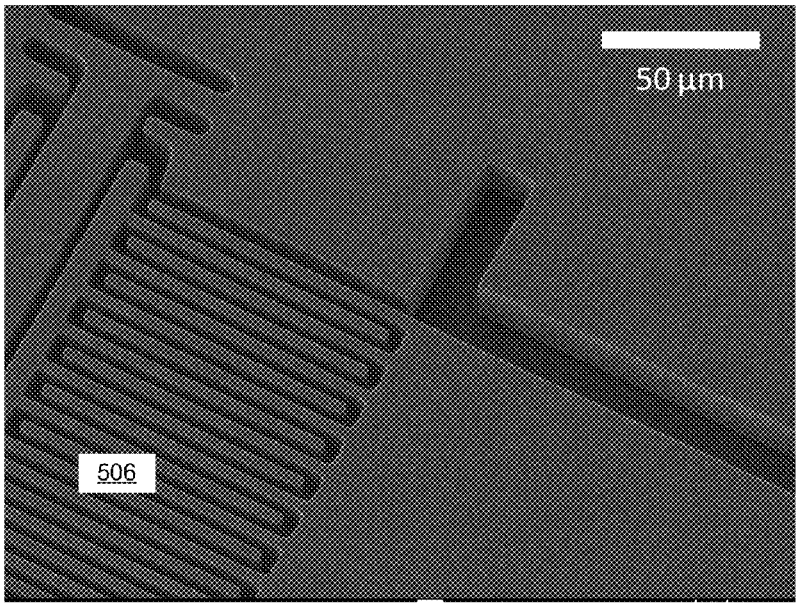
FIG. 5D illustrates a SEM micrograph of example MEMS comb-drive micromirrors of the example MEMS X-ray optics apparatus of FIGS. 1A and 1B and FIGS. 2A and 2B in accordance with preferred embodiments.

Referring also to FIGS. 5A, 5B, and 5C a respective SEM micrograph of example MEMS micromirrors are shown, and FIG. 5D illustrates a SEM micrograph of example MEMS comb-drive actuator for the micromirrors of the example MEMS X-ray optics apparatus 100 and 200 in accordance with preferred embodiments.

In FIG. 5A, an example MEMS micromirror generally designated by the respective reference character 502A is shown. The MEMS micromirror 502A has a generally rectangular shape.

In FIG. 5B, an example MEMS micromirror generally designated by the respective reference character 502B is shown. The MEMS micromirror 502B has an improved rectangular shape with rounded corners.

In FIG. 5C, an example MEMS micromirror generally designated by the respective reference character 502C is shown. The MEMS micromirror 502C has an improved generally oblong shape with rounded corners.

The MEMS micromirrors 502B, 502C have improved or optimized torsional springs and anchors. The MEMS micromirrors 502A, 502B have resonant frequencies, for example, of 2 KHz to 16.5 KHz, and have been X-ray tested. The MEMS micromirror 502C has resonant frequencies, for example, of approximately 75 KHz.

In FIG. 5D, an example MEMS comb-drive actuator generally designated by the respective reference character 506 is shown for the micromirrors 502A, 502B, 502C In accordance with features of the invention, the MEMS micromirrors 300 and 400 are controllably oscillated, about the respective two torsional-beams 304, 404, at varying amplitudes and frequencies, using the respective integrated comb-drive actuators 306, 406.

Figure 6:
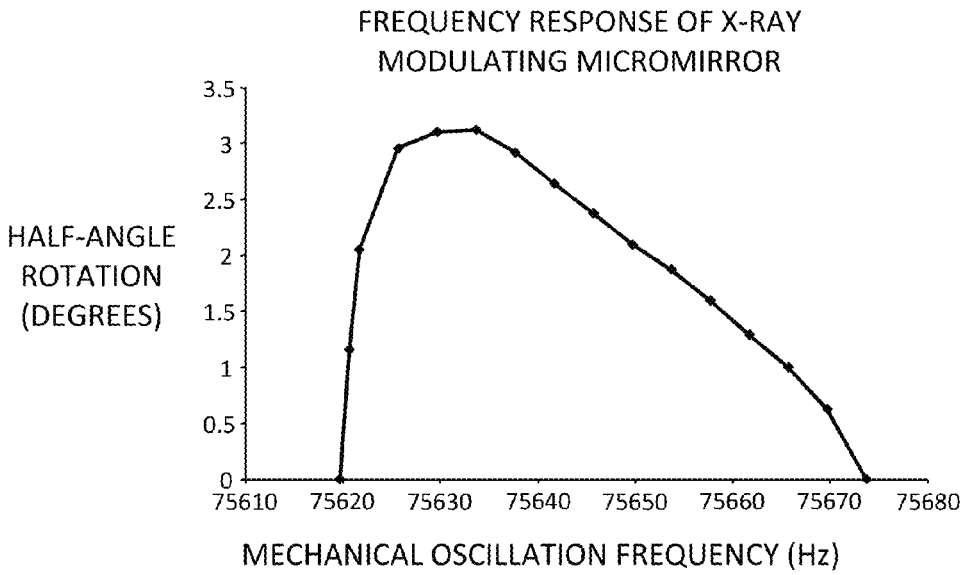
FIG. 6 illustrates change in amplitude of minor-oscillation with change in driving frequency with half-angle rotation in degrees shown relative the vertical axis and mechanical oscillation frequency shown relative the horizontal axis in accordance with preferred embodiments.

FIG. 6 illustrates an example frequency response of X-ray MEMS micromirrors with the change in amplitude of minor-oscillation and in driving frequency, with half-angle rotation in degrees shown relative the vertical axis and mechanical oscillation frequency shown relative the horizontal axis.

In accordance with features of the invention, the combination of grazing angle reflection and controllable mirror-oscillation results in a method for modulating the incident X-ray beam. This modulation includes, but is not limited to, isolating a particular pulse, spatially separating individual pulses, and spreading a single pulse from an X-ray pulse-train.

Figure 7A:
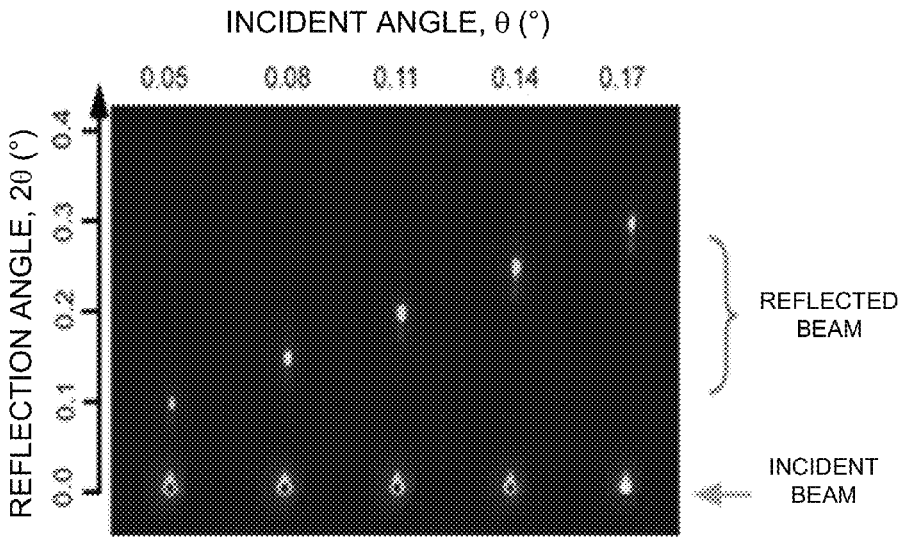
FIGS. 7A and 7B respectively illustrate reflected beam and incident beam examples with incident angle shown relative the horizontal axis and reflection in degrees shown relative the vertical axis in FIG. 7A, and reflectivity, R shown relative the vertical axis in FIG. 7B in accordance with preferred embodiments.
Figure 7B:
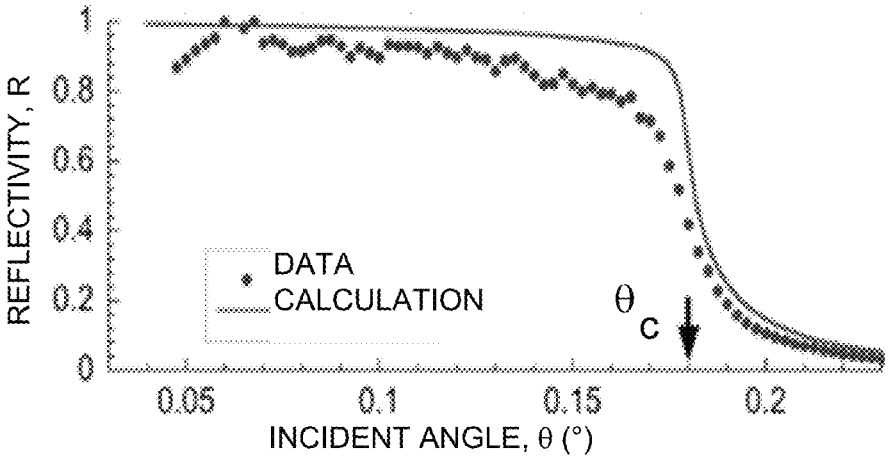

FIGS. 7A and 7B respectively illustrate reflected beam and incident beam examples with incident angle shown relative the horizontal axis and reflection in degrees shown relative the vertical axis in FIG. 7A, and reflectivity, R shown relative the vertical axis in FIG. 7B in accordance with preferred embodiments. In FIG. 7B measured data values are shown relative to calculation values.

Figure 8:
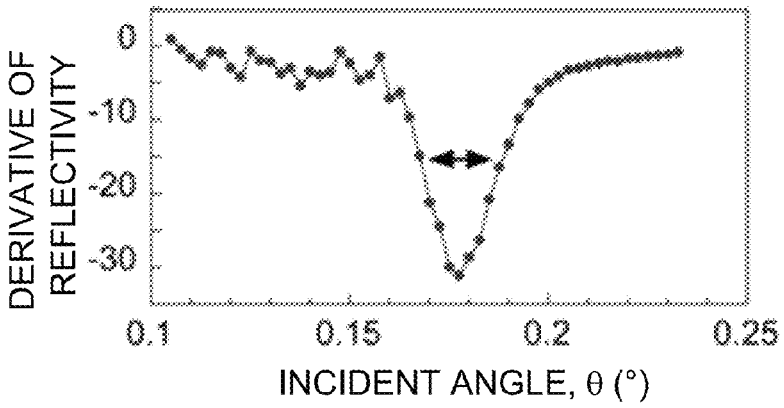
FIG. 8 illustrates derivative of the measured reflectivity curve of FIG. 7B with incident angle shown relative the horizontal axis and derivative of reflectivity shown relative the vertical axis in accordance with preferred embodiments.

FIG. 8 illustrates derivative of the measured reflectivity curve of FIG. 7B with incident angle shown relative the horizontal axis and derivative of reflectivity shown relative the vertical axis in accordance with preferred embodiments. The derivative of measured reflectivity curve shows, for example, the mirror curvature of less than 0.02°.

Figure 9:
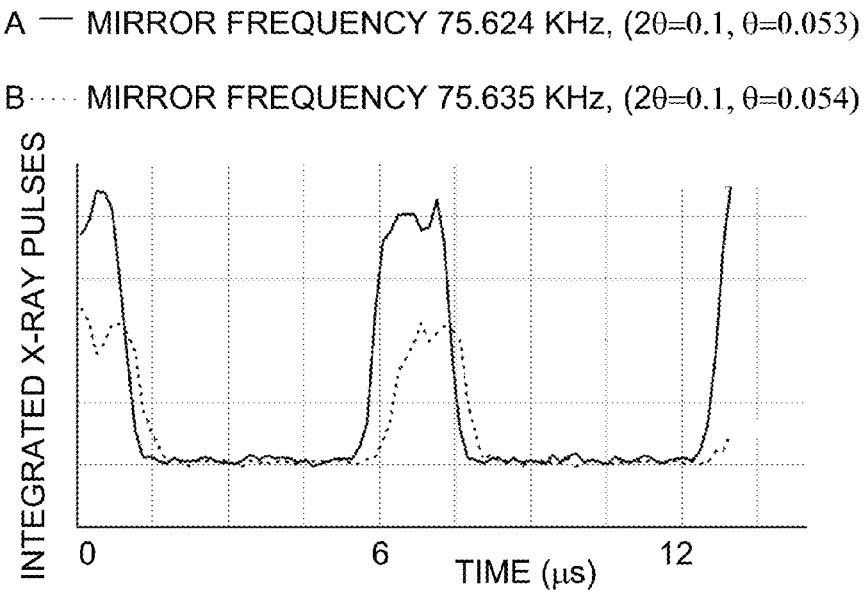
FIG. 9 illustrates example mirror operation with time in microseconds (μs) shown relative the horizontal axis and integrated X-ray pulses shown relative the vertical axis in accordance with preferred embodiments.

FIG. 9 illustrates example mirror operation with time in microseconds (μs) shown relative the horizontal axis and integrated X-ray pulses shown relative the vertical axis in accordance with preferred embodiments. With a first minor frequency, such as 75.624 KHz and the first incident X-ray angle or grazing angle, θ, of 0.053°; and a second minor frequency, such as 75.635 KHz and the second incident X-ray angle or grazing angle, θ, of 0.054° the pulse intensity and pulse duration is changed.

Figure 10:
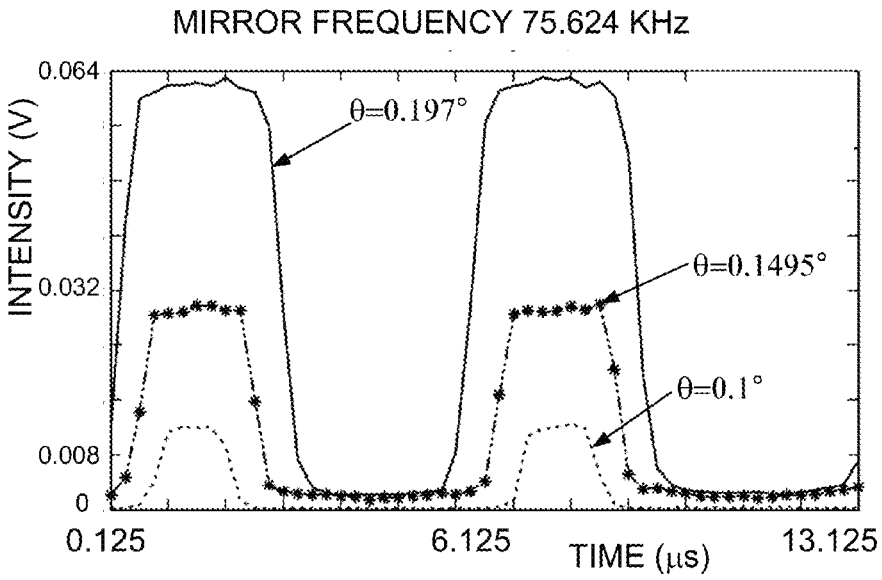
FIG. 10 illustrates example 75.624 KHz minor operation with time in microseconds (μs) shown relative the horizontal axis and intensity (V) shown relative the vertical axis in accordance with preferred embodiments.

FIG. 10 illustrates example 75.624 KHz minor operation with time in microseconds (μs) shown relative the horizontal axis and intensity (V) shown relative the vertical axis in accordance with preferred embodiments. With a fixed minor frequency, such as 75.624 KHz, varying the incident X-ray angle or grazing angle, θ, for examples between 0.197°; 0.1495° and 0.1°, the pulse intensity and pulse duration is changed.

While the present invention has been described with reference to the details of the embodiments of the invention shown in the drawing, these details are not intended to limit the scope of the invention as claimed in the appended claims.

What is claimed is:

1. A method for spatially modulating X-rays or X-ray pulses using MicroElectroMechanical systems (MEMS) X-ray optics comprising:

providing a MEMS micromirror surface;

providing incident X-rays on the MEMS micromirror surface at a set angle of incidence includes providing a pulse train dispersion including incident temporally dispersed X-ray pulses on the MEMS micromirror surface;

providing a mirror frequency for controllably modulating the incident X-rays; and providing an area detector receiving spatially separated X-ray pulse positions from controllably modulating the incident X-ray pulses.

2. The method as recited in claim 1 wherein providing incident X-rays on the MEMS micromirror surface at said set angle of incidence includes providing said set angle of incidence for reflecting the incident X-rays.

3. The method as recited in claim 1 wherein providing incident X-rays on the MEMS micromirror surface at said set angle of incidence includes providing said set angle of incidence less than a critical angle $\theta_c$ said critical angle $\theta_c$ based upon a given X-ray wavelength and a MEMS micromirror surface material.

4. The method as recited in claim 1 wherein providing said MEMS micromirror surface includes providing a torsional mirror.

5. The method as recited in claim 1 wherein providing said MEMS micromirror surface includes providing said MEMS micromirror being fabricated on a single-crystal-silicon (SCS) device layer of a Silicon-On-Insulator (SOI) wafer.

6. The method as recited in claim 1 wherein providing said MEMS micromirror surface includes providing said MEMS micromirror including a respective pair of torsional hinges.

7. The method as recited in claim 1 wherein providing said MEMS micromirror surface includes providing said MEMS micromirror including a respective pair of comb-drive actuators.

8. The method as recited in claim 1 wherein providing said mirror frequency for controllably modulating the incident X-rays includes changing pulse intensity and duration by providing a selected mirror frequency.

9. The method as recited in claim 1 wherein providing incident X-rays on the MEMS micromirror surface at said set angle of incidence includes changing pulse intensity and duration by providing a selected angle of incidence.

10. A method for spatially modulating X-rays or X-ray pulses using MicroElectroMechanical systems (MEMS) X-ray optics comprising:

providing a MEMS micromirror surface;

providing incident X-rays on the MEMS micromirror surface at a set angle of incidence includes providing a short pulse dispersion including a single X-ray pulse on the MEMS micromirror surface;

providing a mirror frequency for controllably modulating the incident X-rays; and providing an area detector receiving a spatially spread X-ray pulse position from controllably modulating the incident short X-ray pulse.

11. The method as recited in claim 10 wherein said single X-ray pulse includes a pulse duration of approximately 100 picosecond (ps).

12. An apparatus for spatially modulating X-rays or X-ray pulses using MicroElectroMechanical systems (MEMS) X-ray optics comprising:

a MEMS micromirror including a MEMS micromirror surface;

an X-ray source providing incident X-rays on the MEMS micromirror surface at a set angle of incidence; and said MEMS micromirror including a mirror frequency, said set angle of incidence of the incident X-rays and said mirror frequency being provided for controllably modulating the incident X-rays; and said micromirror providing a pulse train dispersion, wherein said X-ray source providing incident temporally dispersed X-ray pulses on the MEMS micromirror surface; and an area detector receiving spatially separated X-ray pulse positions from controllably modulating the incident X-ray pulses.

13. The apparatus as recited in claim 12 wherein said MEMS micromirror is fabricated on a single-crystal-silicon (SCS) device layer of a Silicon-On-Insulator (SOI) wafer.

14. The apparatus as recited in claim 12 wherein said MEMS micromirror includes a respective pair of torsional hinges.

15. The apparatus as recited in claim 12 wherein said MEMS micromirror includes a respective pair of comb-drive actuators.

16. The apparatus as recited in claim 12 wherein said set angle of incidence includes a set angle of incidence less than a critical angle $\theta_c$ and said critical angle $\theta_c$ being based upon a given X-ray wavelength and a MEMS micromirror surface material.

17. The apparatus as recited in claim 12 wherein said MEMS micromirror includes a torsional oscillating mirror.

18. An apparatus for spatially modulating X-rays or X-ray pulses using MicroElectroMechanical systems (MEMS) X-ray optics comprising:

a MEMS micromirror including a MEMS micromirror surface;

an X-ray source providing incident X-rays on the MEMS micromirror surface at a set angle of incidence;

said MEMS micromirror including a mirror frequency, said set angle of incidence of the incident X-rays and said mirror frequency being provided for controllably modulating the incident X-rays; and said micromirror providing a short pulse dispersion, wherein said X-ray source providing a single X-ray pulse on the MEMS micromirror surface; and an area detector receiving a spatially spread X-ray pulse position from controllably modulating the incident short X-ray pulse.

* * * * *